United States Patent [19]

Miele et al.

[11] 3,999,349

[45] Dec. 28, 1976

[54] MASONRY WALL CONSTRUCTION AND LAMINATED BUILDING BLOCK UNITS THEREFOR

[75] Inventors: Jean G. Miele, Middle Village; Anthony La Grassa, Richmond Hill, both of N.Y.

[73] Assignees: Anthony La Grassa, Richmond Hill; Jean G. Miele; Joel A. Miele, both of Middle Village, all of N.Y.

[22] Filed: Jan. 28, 1975

[21] Appl. No.: 544,756

[52] U.S. Cl. ..... 52/568; 52/391; 52/404; 52/443; 52/513; 52/747

[51] Int. Cl.[2] ..... E04C 1/02; E04C 1/40

[58] Field of Search ..... 52/404, 408, 410, 443, 52/454, 490, 513, 562, 565–568, 747, 391, 595

[56] References Cited

UNITED STATES PATENTS

| | | | |
|---|---|---|---|
| 1,771,354 | 7/1930 | Sciamanna | 52/513 X |
| 2,791,117 | 5/1957 | Bailey | 52/513 X |
| 3,079,730 | 3/1963 | Donegan | 52/443 X |

*Primary Examiner*—J. Karl Bell

*Attorney, Agent, or Firm*—Eisenman, Allsopp & Strack

[57] ABSTRACT

A masonry wall comprising a plurality of laminated building blocks, wherein each block has an insulation layer laminated to one face. The length and breadth of the insulation layer exceed the corresponding dimensions of the block by the width of the mortar used to bond the blocks in place and the insulation layer is offset from two adjacent edges of the block. This structure is combined with critical dimensions relative to standard modular bricks to produce optimally large blocks for minimum labor and construction costs.

10 Claims, 8 Drawing Figures

MASONRY WALL CONSTRUCTION AND LAMINATED BUILDING BLOCK UNITS THEREFOR

BACKGROUND OF THE INVENTION

1. Field of the Invention

The invention relates to building construction, and more particularly laminated building blocks suitable for the construction of insulated walls.

2. Description of the Prior Art

In masonry construction, it is conventional to employ building blocks of standard size in a keyed succession of courses of tiers, with each block secured in place by mortar. Frequently, such walls are initially formed of poured concrete or concrete block and a brick wythe or facing is secured to this basic wall by straps located within the interstices of selected courses.

Since concrete block and standard modular bricks are frequently used in the aforedescribed construction, conventional hollow concrete blocks are dimensioned to accommodate several courses of brick. On the other hand, it is recognized that there are a number of modular brick sizes and they are not all adaptable to existing concrete masonry units.

It is also well known in the construction industry to provide insulation in conjunction with brick and concrete walls. In the past, insulation in the form of either Fiberglas batting, or sheeting, or more recently polyurethane materials, has been affixed and/or inserted within the conventional building units. In each instance, this addition of insulation to masonry walls has required considerable labor, expense, and sometimes structural modifications.

SUMMARY OF THE INVENTION

The present invention provides a new laminated concrete masonry unit of specific dimensions and form, to provide optimal utilization with existing modular bricks. The building block units of the invention provide upon installation, a wall having both an insulation and vapor barrier, and yet require less labor to install than conventional modular brick construction.

An object of the invention is to provide an improved basic masonry building block.

Another object of the invention is to provide an improved basic masonry block of laminated construction including an insulation and vapor barrier face.

Another object of the invention is to provide an improved masonry block unit adapted for cooperation with similar blocks to provide a flush wall having vapor barrier and insulation characteristics.

Yet another object of the invention is to provide an improved masonry block wall suitable for construction in cooperation with conventional modular bricks of all standard sizes.

In accordance with one aspect of the invention there is provided a laminated rectangular block of narrow width, having a length and/or breadth that is an integral multiple of standard modular brick lengths or heights plus a predetermined mortar allowance. Laminated to one face of this block and offset by equal increments from a first and second edge thereof, is an insulation material having slightly greater length and breadth dimensions.

In accordance with another aspect of the invention there is provided a concrete masonry wall made up of a plurality of relatively narrow blocks having common length and breadth dimensions. One face of each of these blocks has an insulation material laminated thereon; the insulation material being of a length and breadth slightly greater than the corresponding dimensions of said blocks, and being offset from two adjacent edges by a predetermined amount. Each of these blocks are arranged in courses and are bonded by mortar or the like; the mortar spacing between each block being equal to the amount by which the insulation dimensions exceed those of the block. Thus, the completed wall comprises a substantially complete insulation layer on one side and an array of blocks on the opposing side having mortar therebetween.

A more complete understanding of the invention will be available from the following detailed description which is made in conjunction with the drawings.

DESCRIPTION OF THE PREFERRED EMBODIMENTS

Figure 1:
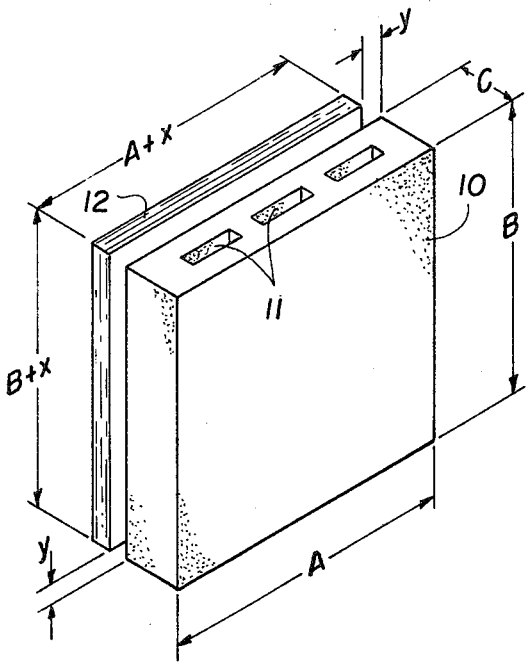
FIG. 1 is a perspective illustration of a typical laminated building unit embodying the invention.

The basic building block 10 of the invention is shown in FIG. 1 and will be seen to be of rectangular configuration. In a typical block, it has been found convenient and desirable to have equal length and breadth dimensions. Accordingly, using the notations of FIG. 1, it is preferable that the dimension A equals the dimension B. The width of the block, C, is relatively narrow and the block is hollowed by the inclusion of channels 11, to economize on material and achieve relatively light weight.

One face of the building block 10 has an insulation material 12 laminated thereon. The length and breadth dimensions of the insulation layer are slightly greater than those of the block, by an amount, $x$. $x$ is equal to the predetermined spacing between installed blocks, which will typically be filled during installation with mortar. The width, D, of the insulation layer is determined by the desired insulation effect and the characteristics of the material employed. It will also be noted that the insulation layer 12 is offset from two adjacent edges of block 10 by a predetermined amount, $y$. The specific amount of offset is not critical; however, it must be greater than $x$, to assure that the butted edges of the insulation do not fall in juxtaposition with the interstices between an array of installed blocks.

Figure 3:
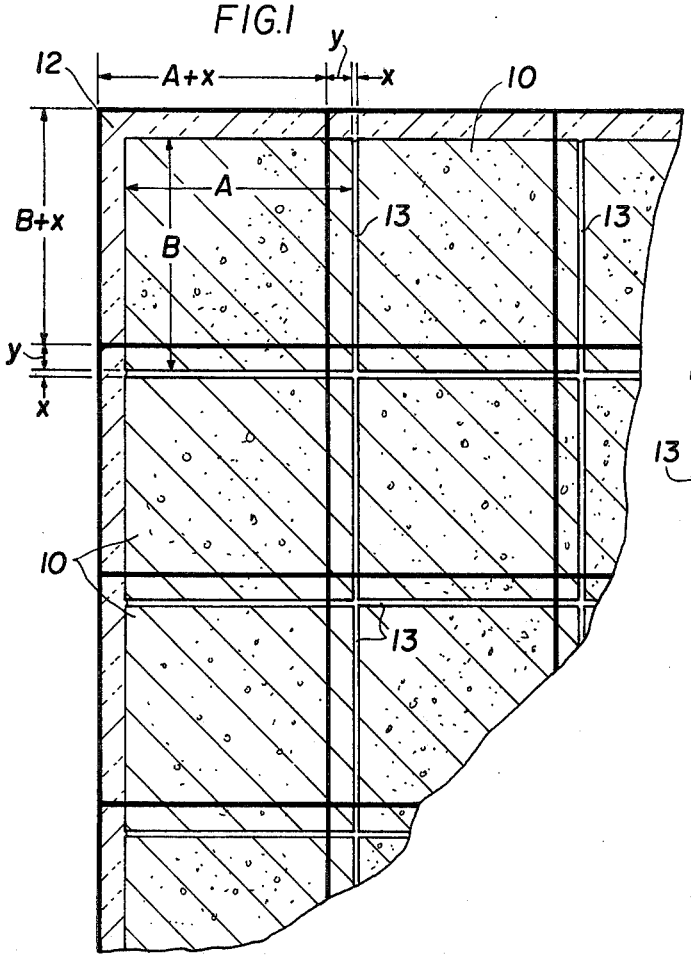
FIG. 3 is a schematic showing a rear elevation of a wall embodying the invention and using the laminated building units thereof.

The selective dimensioning of the laminated portion will be more clearly demonstrated by the rear view of a portion of a wall constructed in accordance with the invention. FIG. 3 schematically shows a plurality of blocks 10 installed in successive courses and bound together by mortar 13. The extended surfaces of the insulation layer 12 are exposed to the left and upper portions of the FIGURE. For purposes of the schematic, the edges of the insulation layer are depicted as heavy black lines. This makes it possible to illustrate the exact position of these edges relative to edges of the blocks to which the insulation is laminated. It will be seen that the edges of the insulation layer are butted directly together, while the edges of the blocks are separated by strips of mortar. This assures continuity of the insulation and where a vapor barrier is provided, it also maintains this barrier.

As clearly demonstrated by the dimensional inserts in FIG. 3, the concrete block portion has length and width dimensions, A, B, respectively. The blocks are separated by mortar 13 which takes up a width *x*. As previously noted, the insulation laminate is offset from two adjacent edges of the block 10 by an amount *y*.

Figure 2:
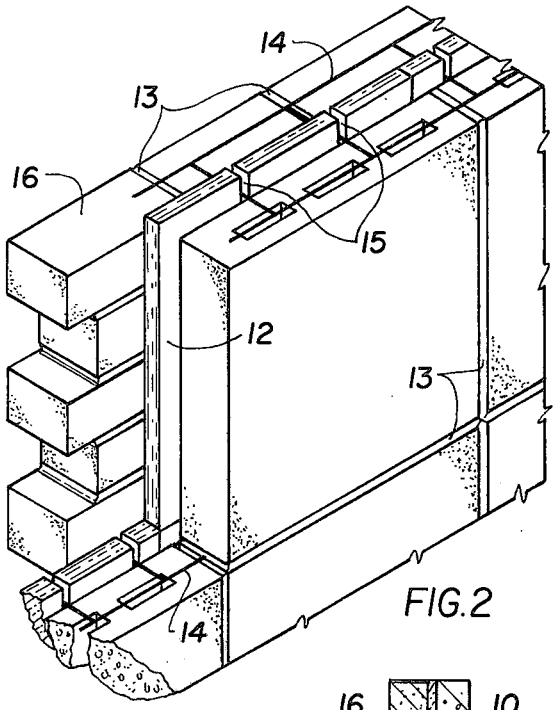
FIG. 2 is a perspective illustration of a portion of a wall embodying the invention, using the building units thereof in combination with standard modular bricks.
Figure 4:
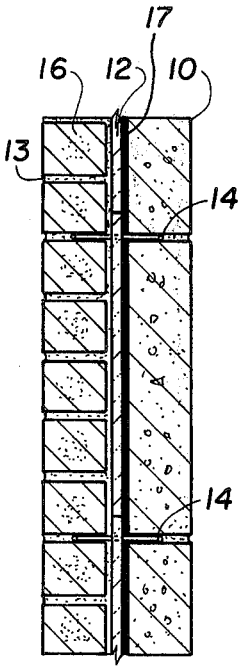
FIG. 4 is a typical section through a wall embodying the invention in combination with a standard modular brick wythe.
Figure 5A:
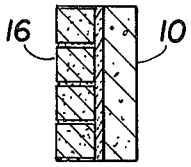
FIGS. 5A through 5D are schematic view illustrating the utilization of the laminated building units of this invention in combination with modular bricks of all standard sizes.
Figure 5B:
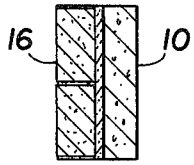
Figure 5C:
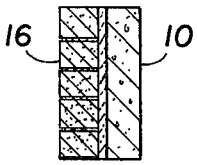
Figure 5D:
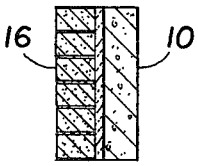

The perspective view of FIG. 2 and the side view of FIG. 4, shown a typical installation of the units of the present invention in combination with a standard modular brick wythe 16. Following each course of the units of this invention, one may typically insert "Dura Wall" masonry reinforcing grids 14 as a strapping means of tying in the brick facing. Where one employs a rigid insulation board for the insulation laminate 12, the grid may be inserted by deforming or slitting the proximate insulation edges as illustrated at 15. On the other hand, it has been found desirable to use a deformable insulation layer such as Fiberglas batting. Where such a resiliently deformable material is employed, the masonry reinforcing initially deforms the edges of the insulation and thereafter the insulation reforms about the penetrating grid work to create a substantially impenetrable shield.

When it is desired to provide not only an insulation barrier, but also a vapor barrier, the insulation layer is supplemented by a vapor layer. Typically, this may be in the form of an aluminum sheet interposed between the insulation material and the proximate concrete block surface. This is suggested, for example, by the heavy line 17 in FIG. 4. One particular construction might include, for example, an insulation layer formed of Fiberglas material sandwiched between a kraft paper and aluminum sheet; with the aluminum sheet bonded to the surface of the concrete block.

As noted previously, it has been found advantageous to dimension the laminated building blocks of this invention with equal length and breadth. FIGS. 5A through 5D illustrate further the selection of a critical and desirable overall dimension for this block. These FIGURES illustrate side views of a laminated building block 10, adjacent to brick wythes 16 using the standard modular brick sizes. As known in the trade, the standard modular brick sizes are 3-⅝ inches, 7-⅝ inches, 2-⅞ inches, and 2-¼ inches, respectively. Thus, FIGS. 5A through 5D illustrate modular bricks having these dimensions and demonstrate that an optimum height for the building block of this invention is 15-⅝ inches. This assures that an integral number of courses of standard modular brick sizes may be installed with the common ⅜ of an inch spacing for mortar between each course. It also insures that the size and weight of the building blocks used in this invention, are convenient to manufacture, transport, and install.

In addition to using the masonry blocks of this invention with standard modular facing bricks, it is also possible to often convenient to install adjacent wythes of these blocks themselves. When this is done, the insulation and/or barrier layers are placed in proximity to one another and the reverse face of blocks provides the exterior and interior facing.

The building blocks of this invention have been found to provide the means for constructing walls of superior insulation and vapor barrier characteristics, with a minimum of labor and time consumption. The building blocks are also convenient to manufacture, easily shipped and protected during shipping by the extending edges of insulation. Other benefits and features of these building blocks will be apparent to those skilled in the art. Any such benefits and features, and any modifications that might be made within the teachings of this invention, are intended to be covered by the appended claims.

What is claimed is:

1. A building unit for installation in keyed courses wherein a plurality of such units are arrayed with a spacing *x* between adjacent edges, comprising: a masonry block having length, breadth and width dimensions A, B, and C, respectively; an insulation layer bonded to one face of said block and having length and breadth dimensions A+*x*, and B+*x*, respectively; two adjacent edges of said insulation layer being offset from the proximate adjacent edges of said block by a predetermined distance, *y;* said distance being greater than *x*.

2. A building unit as defined in claim 1, wherein A equals B.

3. A building unit as defined in claim 1, for use with standard modular bricks of various sizes held in courses with said spacing *x* therebetween, said dimensions A and B being equal to the length and breadth dimensions respectively of a plurality of said bricks when arranged side-by-side with mortar therebetween.

4. A building unit as defined in claim 1, including hollow channels through said masonry block.

5. A building unit as defined in claim 1, wherein said insulation layer is resiliently deformable.

6. A building unit as defined in claim 1, including a vapor barrier layer interposed between said insulation layer and said face of the block, said barrier layer having the same length and breadth dimensions as said insulation layer.

7. A masonry wall comprising in combination:

a. a plurality of laminated masonry blocks having length, breadth and width dimensions A, B, and C, respectively; an insulation layer bonded to one face of said block and having length and breadth dimensions A+x, and B+x, respectively; two adjacent edges of said insulation layer being offset from the proximate adjacent edges of said block by a predetermined distance, *y;* said distance *y* being greater than *x;* b. said masonry blocks being arrayed in successive courses and bonded together with interstices between each block of width *x;* c. said interstices being filled by mortar.

8. A masonry wall as defined in claim 7, wherein each of said masonry blocks has a vapor barrier layer interposed between said insulation layer and said face of the block, said barrier layer having the same length and breadth dimensions as said insulation layer.

9. A masonry wall as defined in claim 7, comprising a brick wythe adjacent to the exposed face of said insulation layer; and strapping means coupling said brick wythe to the arrayed masonry blocks where said bricks and blocks have horizontal interstices of common elevation.

10. A masonry wall as defined in claim 7, including a wythe comprising a second plurality of said masonry blocks of similar dimensions and structure arrayed in successive courses and bonded together with interstices between each block of width $x$, the insulation layers of the blocks of the first and second pluralities being in proximity; a strapping means coupling said wythe to the first plurality of masonry blocks.

* * * * *

UNITED STATES PATENT OFFICE

CERTIFICATE OF CORRECTION

Patent No. 3,999,349 Dated December 28, 1976

Inventor(s) Jean G. Miele and Anthony La Grassa

It is certified that error appears in the above-identified patent and that said Letters Patent are hereby corrected as shown below:

Column 2, line 30 "view" should be --views--.

Column 3, line 18 "shown" should be --show--.

Column 6, line 3 "a" should be --and--.

Signed and Sealed this

Eighth Day of March 1977

[SEAL]

*Attest:*

RUTH C. MASON
*Attesting Officer*

C. MARSHALL DANN
*Commissioner of Patents and Trademarks*